US007814589B2

(12) United States Patent
Loh

(10) Patent No.: US 7,814,589 B2
(45) Date of Patent: Oct. 19, 2010

(54) TERRACE COMFORTER

(76) Inventor: Cheng Wah Loh, 8818 Emperor Ave., San Gabriel, CA (US) 91775

( * ) Notice: Subject to any disclaimer, the term of this patent is extended or adjusted under 35 U.S.C. 154(b) by 801 days.

(21) Appl. No.: 11/809,872

(22) Filed: Jun. 1, 2007

(65) Prior Publication Data

US 2007/0277315 A1 Dec. 6, 2007

Related U.S. Application Data

(60) Provisional application No. 60/810,876, filed on Jun. 2, 2006.

(51) Int. Cl.
*A47G 9/02* (2006.01)

(52) U.S. Cl. ..... 5/502; 5/486

(58) Field of Classification Search ..... 5/485, 5/486, 502, 691, 722, 731; 112/420, 440
See application file for complete search history.

(56) References Cited

U.S. PATENT DOCUMENTS 5,483,713 A * 1/1996 Kikuchi et al. ..... 5/502
5,708,995 A * 1/1998 Wu et al. ..... 5/486
5,987,669 A * 11/1999 Leggett et al. ..... 5/502
6,301,730 B1 * 10/2001 Delfs et al. ..... 5/502
6,957,465 B1 * 10/2005 Oprandi ..... 5/727
6,961,970 B2 * 11/2005 Pedersen ..... 5/502
7,045,191 B2 * 5/2006 Huntley ..... 428/137
7,162,756 B2 * 1/2007 Schweigert ..... 5/502
7,647,657 B2 * 1/2010 Delfs ..... 5/482

* cited by examiner

*Primary Examiner*—Michael Trettel
(74) *Attorney, Agent, or Firm*—Clement Cheng

(57) ABSTRACT

The terrace comforter is made by a shell with many tubes of the same width and length sitting side by side from one end of the shell extended to the other end. Each tube consists of several and the same number of baffled boxes separated by walls between them. There are one or two small holes on the baffled walls in each box so that the filling materials can be blown into the box with a metal tube inserted through the holes on those baffled walls into the box and stay there for a long period of time before moving into the next boxes. The height of boxes can be the same or different as long as the space in each box is large enough for the filling material to expand to its fullest volume.

12 Claims, 5 Drawing Sheets

TERRACE COMFORTER

This application claims priority from Cheng Wah Loh's Provisional entitled Terrace Comforter 60/810,876 filed Jun. 2, 2006.

BACKGROUND OF THE INVENTION

This invention relates generally to comforters. A variety of differently insulated and variably insulated comforters have been patented such as the Variably Insulated Blanket U.S. Pat. No. 5,708,995 patented Jan. 20, 1998, the disclosure of which is incorporated herein by reference. A variety of blankets in the prior art show different sections of different thickness allowing sleepers to configure their comforters according to their thermal needs.

SUMMARY OF THE INVENTION

While being user friendly, a variety of prior art variably insulated blankets have been difficult to manufacture because of the continuously variable requirements of the thickness and insulation variations. Therefore, it is an objective of the present invention to provide a variably insulated blanket that is easier to manufacture, but yet can still fit user needs, enhance the quality of sleep and save energy for heating the room. A principal objective of the present invention is to provide a terrace comforter that will overcome the deficiencies of the prior art devices.

The invention is a comforter that consists of columns and rows of boxes preferably of same width and length in a matrix appearing like a chess board. The whole comforter can be divided into sections which are groups of boxes so that the terrace like structures of different kinds may achieve different purposes. The weights of the filling material in the other boxes in one direction along the same column or same row as the box with the maximum weight preferably decreases by the same amount of filling material equal to a weight decrement between adjacent boxes. In the opposite direction the weights of the filling material in the other boxes along the same column or same row as the box with the maximum weight may also decrease by the same weight decrement or different weight decrement between adjacent boxes. Often times the amount of decrease of filling is the same from a box to an adjacent box.

Also the decreasing of filling material may stop at any box in the column or row for some special reason. For example, the weight of the filling material in the next box will be less than a given designated weight. Discontinuities in filling material amount decrease may occur when there is no room for decreasing to take place such as when the next box would have no filling, by design. There may be a uniform transition area in a certain part of the column or row or the whole column or row where the thickness of the column or row varies uniformly from thick to thin.

The notation and formula for decreasing the amount of insulation can be explained as follows. The maximum weight Wmax, the weight decrement w' and sometimes the designated weight=Wd at the end of the decrement are the major parameters characterizing each individual section. In some cases the given designated weight Wd happens to be the weight of the box at the end of the column (or row) and a user wishes to have a uniformly varied thickness between the box with the Wmax and the box with Wd=the designated weight (or uniformly varied thickness from the box with the Wmax to the box at the end of the column). Then w'=weight decrement is no longer arbitrary and will be calculated by a Terrace Form Insulation Formula as follows: $w'=(Wmax-Wd)/(n-1)$ where n=number of box from Wmax to Wd.

DETAILED DESCRIPTION OF THE PREFERRED EMBODIMENT

Figure 1:
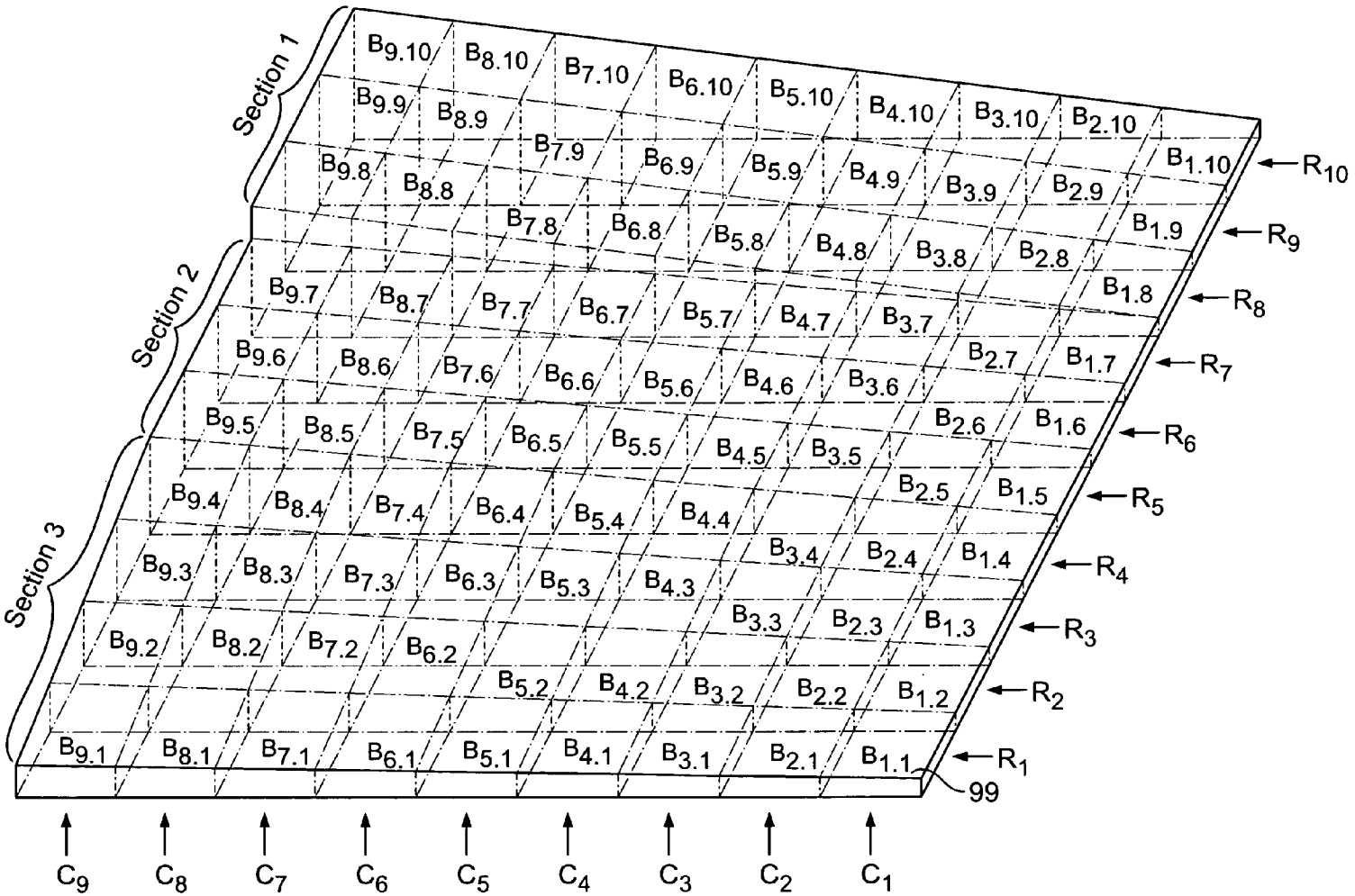
FIG. 1 is a perspective diagram view of the present invention.

FIG. 1 is an example of the baffled box structure 99 of a down comforter having nine columns and ten rows. Each box may have but does not necessarily have the same length and width. The height and volume of boxes can be the same or different as long as the space in each box is large enough for the filling material to expand to its fullest volume. Each box may have a different height to form a profile as shown in the figures. FIG. 1 is a perspective view of the terrace comforter shell with each box of the same width and length for purposes of simplicity in describing the invention. The matrix structure has fabric sidewalls defining boxes. The matrix structure can also be radial cell shaped boxes, or diamond shaped boxes and not necessarily square shaped. For purposes of the detailed description of the preferred embodiment, the box shaped embodiment will be described. In each box, the fabric sidewalls define four walls that bound the edges of the box. The top of the box and the bottom of the box may be formed as a single sheet of fabric. The boxes are filled to different degrees from 0% to 100% filling with an organic insulation filler or stuffing such as down or plastic fibers.

We can assume that the volume of the boxes is approximately proportional to the weight of the filling material inside the boxes. For purposes of reference, each box has columns and rows assigned such that labels are given. FIG. 1 shows column and row numbers. $B_{x,y}$ denotes box number having x th column and y th row. X and Y are integer numbers representing the column and row number.

FIG. 1 is a perspective cutout view of the terrace comforter having three sections. Each section has different varied thickness for varying insulation. In general the weights of filling material is approximately proportional to the sizes of the boxes. The first section comprised of three rows has the thickest filling at the higher numbered columns that incrementally tapers to a lower filling at the first column. The second section comprised of three rows begins at a different and lower thickness area on the highest column and decreases incrementally to the lowest filling on the first column. The third section is four rows and has box $B_{9,4}$ which represents the thickest box in the section. From the thickest box in the third section, the boxes become smaller with smaller filling material in each box as the columns decrease. Also, the lower rows of the third section begin with less material and volume than box $B_{9,4}$ which represents the thickest box in the section. Only in the third section does the amount of material in the thickest box of each row decrease as the rows decrease. Each box is filled with an amount of material that is generally proportional to the size of the box. The size of the box is the volume of the box formed by the sidewalls.

Alternatively, the terrace comforter can have a single section similar to section three where the four boxes at the four corners carry different amounts of filling material; and filling material decreases as the rows decrease and decreases as the columns decrease.

FIG. 1 is a perspective cutout view of the terrace comforter with only one section where the two adjacent corner boxes having different and heavier weights while the other two corner boxes having the same but lighter weights. The transition area between the four corner boxes still vary uniformly in thickness.

Figure 2:
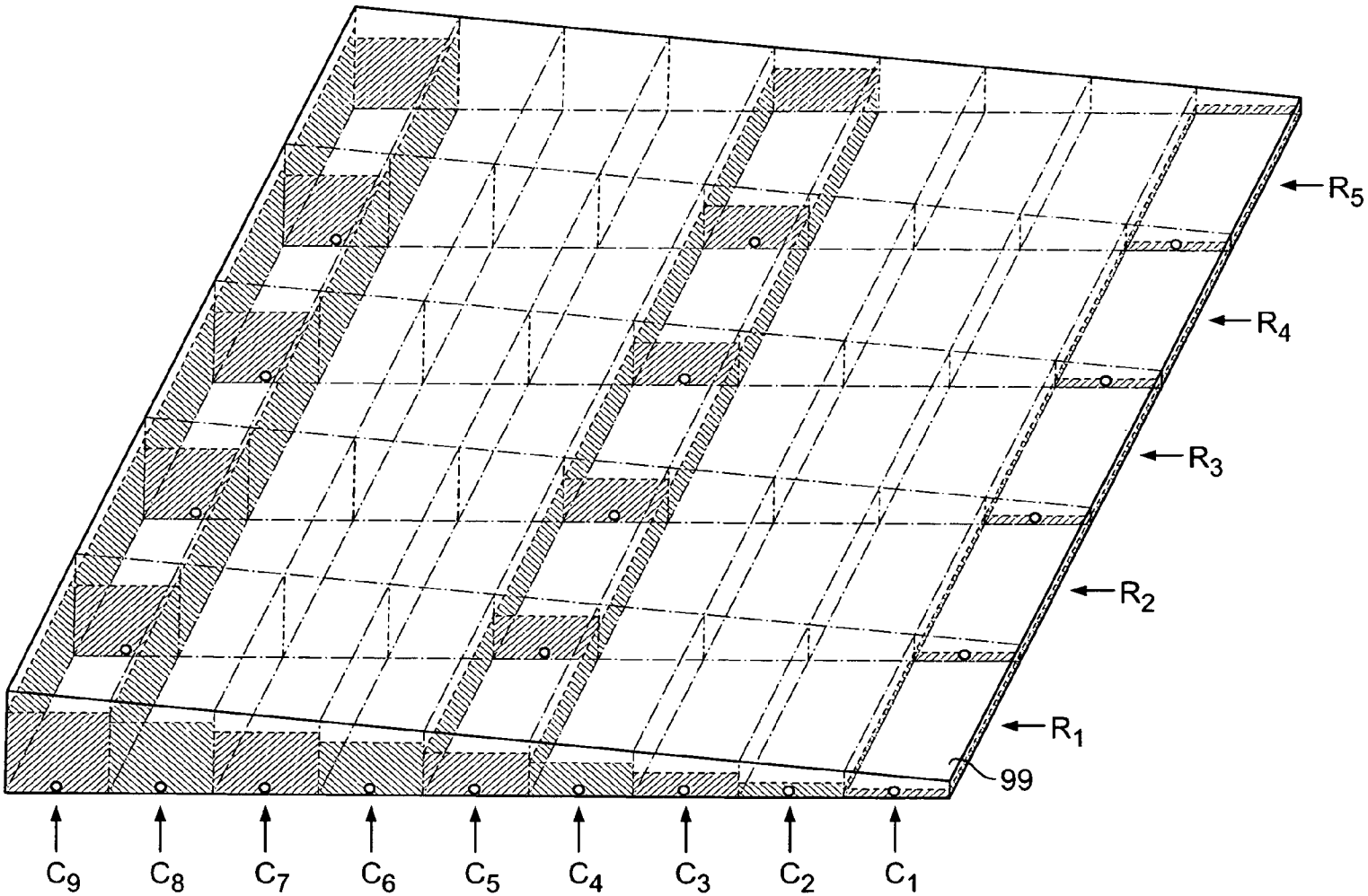
FIG. 2 is a perspective diagram view of the present invention.

FIG. 2 is a perspective cutout view of the terrace comforter with each box of the same width and length but having variable heights in only five rows. The shaded areas in C1, C5 and C9 represent the filling material in those columns. The amount of filling material steps down in discrete increments from the highest to lowest filling. Sizes of boxes are approximately proportional to the amounts of filling material inside the boxes assuming that the space in the boxes are large enough for the filling material to expand to their fullest volume.

The amount of filling material is approximately proportional to the cross-section area shown in FIG. 2. The cross-sectional areas show a step down profile with decreasing amount of filling as the column numbers decrease. On the other hand, the boxes can be of the same volume and having different amounts of filling. Thus, in an equal box volume embodiment, some boxes will be filled to a smaller amount than adjacent boxes. The equal box embodiment is not shown since it would be easy to make by a person of ordinary skill in the art given the disclosure of FIG. 2.

The profile can be changed such as by making the foot section sector to accommodate people who have cold feet. Also, areas where there is little or no stuffing or filling can allow a user to have thinner areas that can be folded under the user or otherwise tucked in. The thinner column can be added parallel and right next to the thickest column in the terrace comforter for the purpose of folding. The thinner column can also be formed as a flap that goes around the entire comforter. Therefore, the thinner column can form a flap that allows the user to tuck in the blanket. A flap can be empty boxes, or formed as a sheet of a single or multiple layer fabric that does not have dividing sidewalls defining boxes. Therefore, the flap can be formed by failing to fill boxes, or by not having boxes at all.

Figure 3:
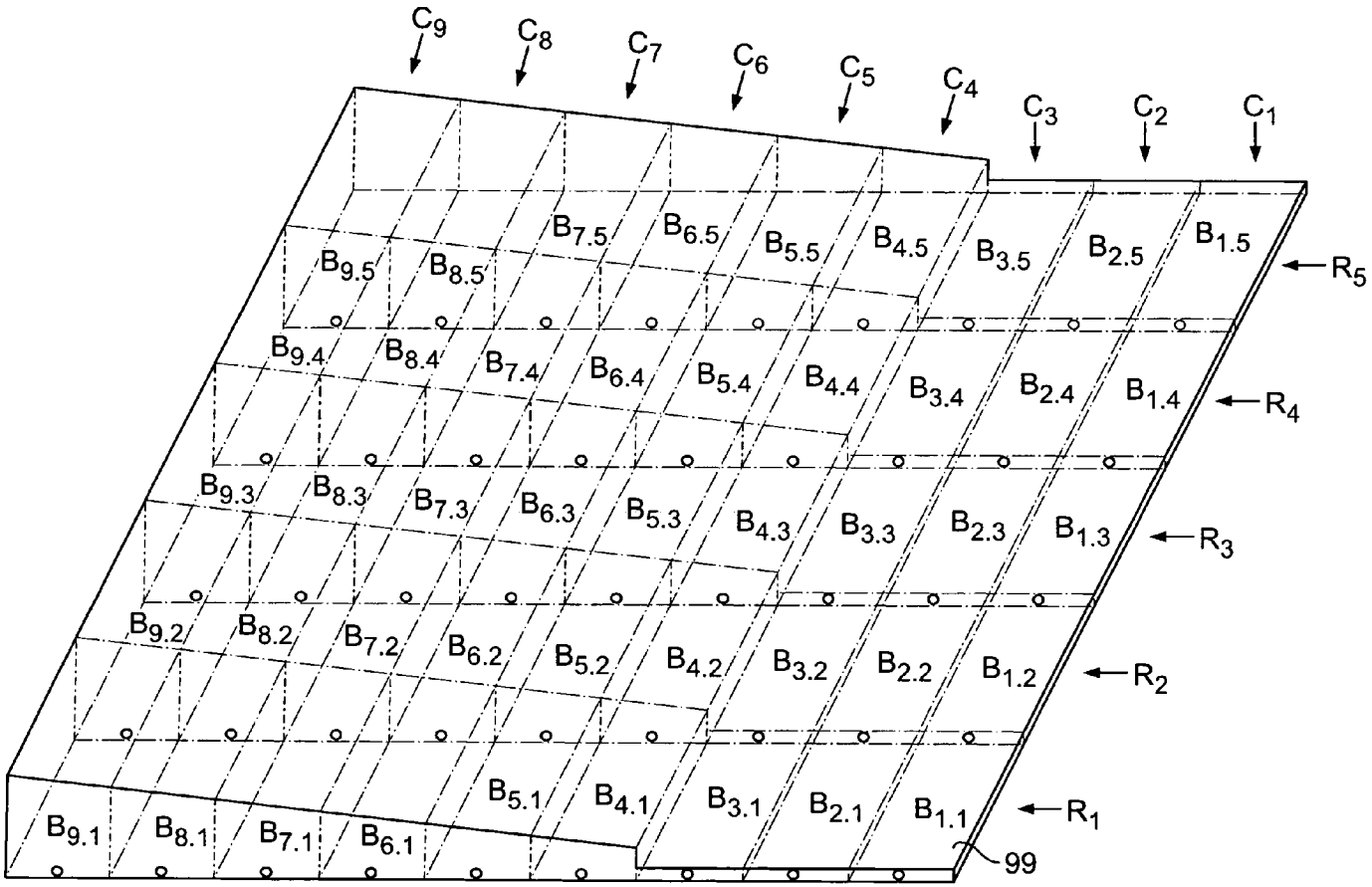
FIG. 3 is a perspective and cross-section view.

FIG. 3 is a perspective cutout view of another terrace comforter with two sections for special purpose. The vertical sidewalls segmenting rows from each other have flaps or openings allowing a tube to fill boxes starting from the highest numbered row down to the lowest numbered row, where the columns are preferably filled one at a time. The filler hose would be inserted from the lowest to the highest rows, then filled while removing the filler hose. Multiple rigid filler hose tubes may insert into multiple boxes and fill more than one column at a time. In FIG. 3, the lowest three columns are not filled with much material or may be empty. The unfilled or less filled area may be used for folding the sheet such as tucking the sheet. Sections can be made first separately and then sewn together later. Again, the less filled area to the right shows a flap that can be used for tucking in. A variety of filling can be used such as polyester or down. The flap can also be used as the thinnest, moisture absorbing and most breathable section to allow warm weather use.

Figure 4:
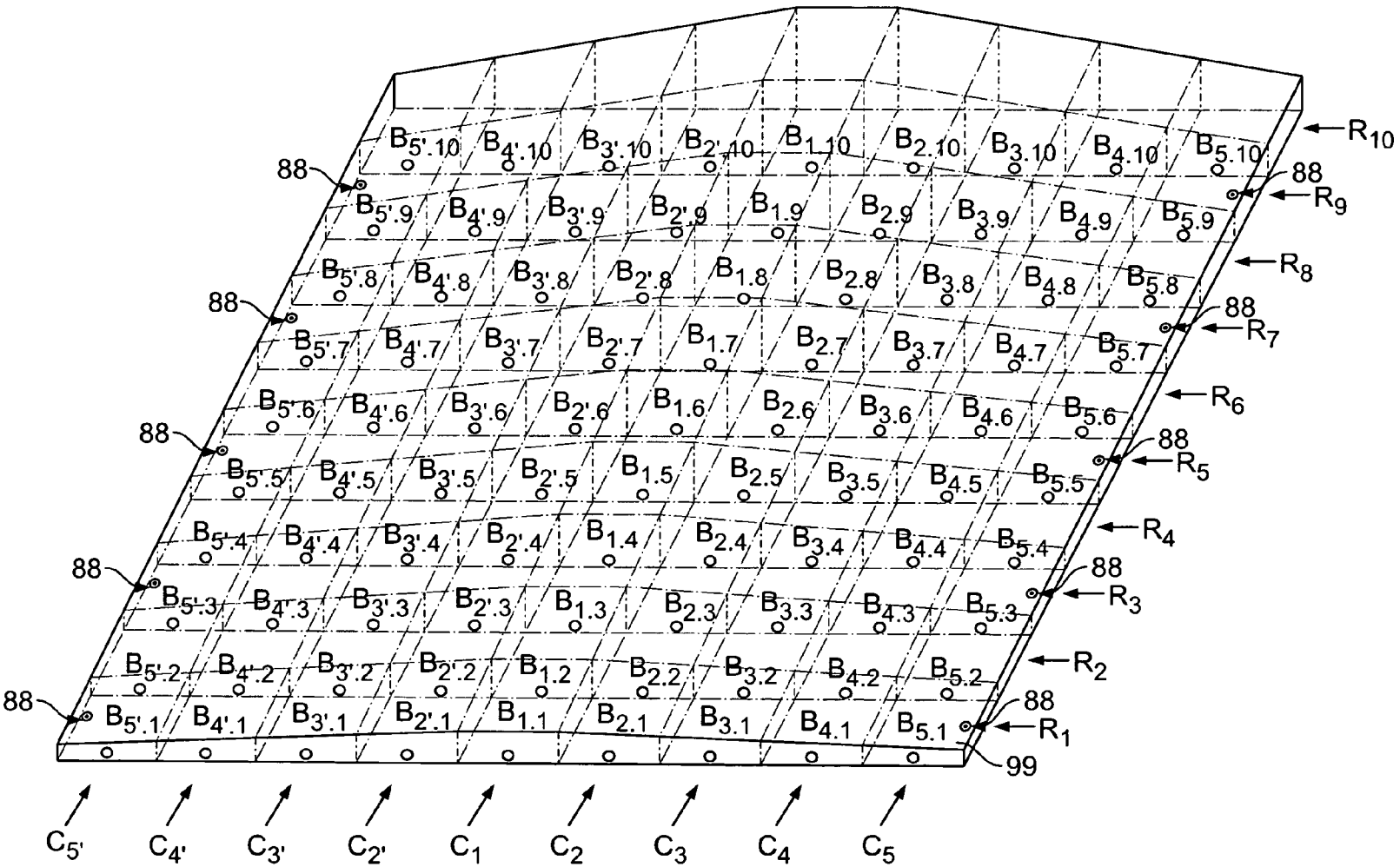
FIG. 4 is a perspective view of a ridge thick comforter.

As seen in FIG. 4 it is also possible to connect a pair of terrace comforters along the length of the thickest area so that the thickest area is in the middle while the thinner areas are on the side. The middle area would thus be warmer. This configuration as seen in FIG. 4 allows for a couple to use the comforter so that the edges are cooler. Here, the terrace comforter has maximum filling at the top center box.

Figure 5:
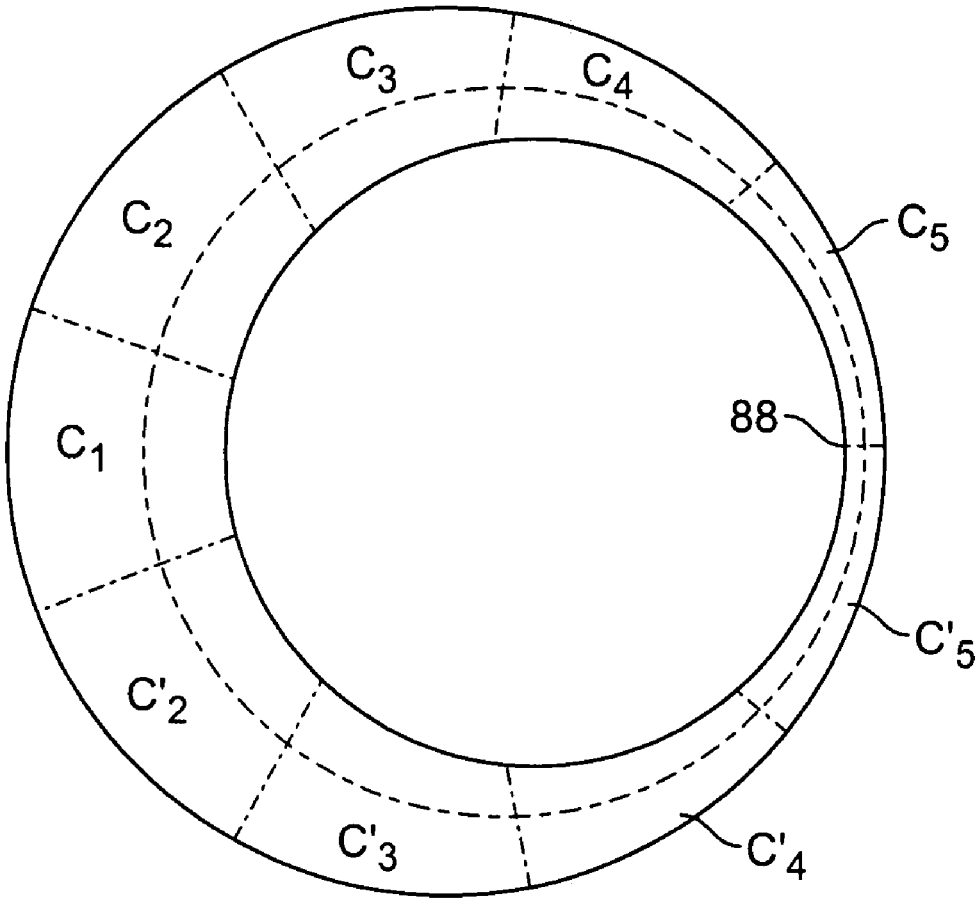
FIG. 5 is a cross-section view of a ridge thick comforter as a sleeping bag.

Fasteners at the outer edge on columns C5 and C5' join together the terrace comforter and turns it into a cylinder shape or tube shape and may function like a sleeping bag as seen in FIG. 5. The fasteners 88 can be buttons, snap buttons, zippers, Velcro or the like.

A comforter can be made to be a variably insulated blanket having variable thickness from a heavy end to a lighter end. Since each column and each box may have the same width and length the weight of filling material in each column and each box may be related to the two heights on opposite side of the column and box along the length of the column or proportional to the area of the identical trapezoids on both ends of the column and box perpendicular to the length of the column. If we assume the minimum amount of filling material is used to expand each column and box to its fullest volume and the density of filling material is the same throughout the comforter as a result.

The best mode is as follows: The terrace comforter is made by a shell with many fabric tubes of the same width and length sitting side by side from one end of the shell extended to the other end. Preferably, the tolerance is such that the length of each box does not vary by more than 5%. Each fabric tube consists of several and the same number of baffled boxes separated by walls between them. There are one or two small circular holes on the baffled walls in each box so that the filling materials can be blown into the box with a metal tube inserted through the holes on those baffled walls into the box and stay there for a long period of time before moving into the next boxes. The fabric tubes have the same width and length so that all of the boxes also have the same width and length. The height of boxes can be the same or different as long as the space in each box is large enough for the filling material to expand to its fullest volume.

The invention claimed is:

1. A comforter comprising:

a. a plurality of boxes, wherein there are at least sixteen boxes in four rows and four columns;

b. a section comprising a group of adjacent fabric boxes formed from the plurality of boxes;

c. filling material filled into at least four adjacent boxes of a higher filled box, a medium higher filled box, a medium lower filled box and a lower filled box, wherein the weight of the filling material in the at least four adjacent boxes differs in decreasing amount starting from a greatest amount in the higher filled box, then decreasing to the medium higher filled box, then medium lower filled box and then to the lower filled box.

2. The comforter of claim 1, wherein further comprising a second section which comprises a group of adjacent fabric boxes formed from the plurality of boxes; further comprising second section filling material filled into at least two adjacent second section boxes which is also filled into the second section of a second section higher filled box and a second section lower filled box, wherein the weight of the filling material in the at least two adjacent second section boxes differs.

3. The comforter of claim 1, wherein the adjacent fabric boxes formed from the plurality of boxes has filling material filled into at least three adjacent boxes defined from the set of the higher filled box, a medium filled box, the lower filled box, wherein the weight of the filling material in the at least three adjacent boxes differs with the higher filled box having more filling material than the medium filled box, and the medium filled box having more filling material than the lower filled box.

4. The comforter of claim 3, further comprising a second section which comprises a group of adjacent fabric boxes formed from the plurality of boxes; further comprising second section filling material filled into at least three adjacent second section boxes which is also filled into the second section of a second section higher filled box and a second section lower filled box, wherein the weight of the filling material in the at least two adjacent second section boxes differs; further comprising a second section medium filled box that has more filling material than the second section lower filled box and less filling material than the second section higher filled box, wherein the second section medium filled box is adjacent to the second section higher filled box and the second section lower filled box.

5. The comforter of claim 4, wherein a change in the amount of filling material stops at any box in a column so that the remainder of the boxes in the same column have the same amount of filling material and thus the same thickness such as that of a regular comforter.

6. The comforter of claim 1, wherein further comprising a second section which comprises a group of adjacent fabric boxes formed from the plurality of boxes; further comprising second section filling material filled into at least two adjacent second section boxes which is also filled into the second section of a second section higher filled box and a second section lower filled box, wherein the weight of the filling material in the at least two adjacent second section boxes differs, wherein a change in the amount of filling material stops at any box in a column so that the remainder of the boxes in the same column have the same amount of filling material and thus the same thickness such as that of a regular comforter.

7. A comforter comprising:

a. a plurality of boxes, wherein there are at least four boxes in two rows and two columns;

b. a section comprising a group of adjacent fabric boxes formed from the plurality of boxes;

c. filling material filled into at least two adjacent boxes of a higher filled box and a lower filled box, wherein the weight of the filling material in the at least two adjacent boxes differs;

d. a flap comprised of an area of comforter where there is no filling material.

8. The comforter of claim 7, wherein further comprising a second section which comprises a group of adjacent fabric boxes formed from the plurality of boxes; further comprising second section filling material filled into at least two adjacent second section boxes which is also filled into the second section of a second section higher filled box and a second section lower filled box, wherein the weight of the filling material in the at least two adjacent second section boxes differs.

9. The comforter of claim 7, wherein the adjacent fabric boxes formed from the plurality of boxes has filling material filled into at least three adjacent boxes defined from the set of the higher filled box, a medium filled box, the lower filled box, wherein the weight of the filling material in the at least three adjacent boxes differs with the higher filled box having more filling material than the medium filled box, and the medium filled box having more filling material than the lower filled box.

10. The comforter of claim 9, further comprising a second section which comprises a group of adjacent fabric boxes formed from the plurality of boxes; further comprising second section filling material filled into at least three adjacent second section boxes which is also filled into the second section of a second section higher filled box and a second section lower filled box, wherein the weight of the filling material in the at least two adjacent second section boxes differs; further comprising a second section medium filled box that has more filling material than the second section lower filled box and less filling material than the second section higher filled box, wherein the second section medium filled box is adjacent to the second section higher filled box and the second section lower filled box.

11. The comforter of claim 10, wherein a change in the amount of filling material stops at any box in a column so that the remainder of the boxes in the same column have the same amount of filling material and thus the same thickness such as that of a regular comforter.

12. The comforter of claim 7, wherein further comprising a second section which comprises a group of adjacent fabric boxes formed from the plurality of boxes; further comprising second section filling material filled into at least two adjacent second section boxes which is also filled into the second section of a second section higher filled box and a second section lower filled box, wherein the weight of the filling material in the at least two adjacent second section boxes differs, wherein a change in the amount of filling material stops at any box in a column so that the remainder of the boxes in the same column have the same amount of filling material and thus the same thickness such as that of a regular comforter.

* * * * *